US009488926B2

(12) United States Patent
Tamagaki et al.

(10) Patent No.: US 9,488,926 B2
(45) **Date of Patent: *Nov. 8, 2016**

(54) TONER AND METHOD OF MANUFACTURING SAME

(71) Applicant: KYOCERA Document Solutions Inc., Osaka (JP)

(72) Inventors: Masashi Tamagaki, Osaka (JP); Tomoyuki Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/539,193

(22) Filed: Nov. 12, 2014

(65) Prior Publication Data

US 2015/0140486 A1 May 21, 2015

(30) Foreign Application Priority Data

Nov. 21, 2013 (JP) ..... 2013-240932

(51) Int. Cl.
*G03G 9/093* (2006.01)
*G03G 9/113* (2006.01)
*G03G 9/097* (2006.01)

(52) U.S. Cl.
CPC ..... *G03G 9/1139* (2013.01); *G03G 9/09392* (2013.01); *G03G 9/09716* (2013.01); *G03G 9/09725* (2013.01)

(58) Field of Classification Search
CPC ..... G03G 9/09307
See application file for complete search history.

(56) References Cited

U.S. PATENT DOCUMENTS 4,968,577 A * 11/1990 Kohri ..... G03G 9/0825 428/402.21
4,973,541 A * 11/1990 Kohri ..... G03G 9/093 428/402.21
5,225,308 A * 7/1993 Sasaki ..... G03G 9/09328 430/110.2
5,302,486 A * 4/1994 Patel ..... G03G 9/09321 430/110.2
9,285,695 B2 * 3/2016 Miki ..... G03G 9/0935
2005/0233238 A1 * 10/2005 Eida ..... G03G 9/081 430/108.7
2010/0203442 A1 * 8/2010 Ohmura ..... G03G 9/0806 430/110.1
2011/0305984 A1 * 12/2011 Tominaga ..... G03G 9/09314 430/108.4
2013/0236828 A1 * 9/2013 Mizoguchi ..... G03G 9/08755 430/109.4
2015/0099221 A1 * 4/2015 Tsujihiro ..... G03G 9/093 430/108.4
2015/0140488 A1 * 5/2015 Terasaki ..... G03G 9/0825 430/109.1

FOREIGN PATENT DOCUMENTS

JP H05-100471 A 4/1993
JP 2002-365835 A 12/2002
JP 2004-233650 A 8/2004
WO WO2013/039257 * 3/2013 ..... G03G 9/08

* cited by examiner

*Primary Examiner* — Hoa V Le
(74) *Attorney, Agent, or Firm* — Studebaker & Brackett PC

(57) ABSTRACT

A toner includes a plurality of toner particles that each include a toner mother particle and an external additive adhering to a surface of the toner mother particle. The toner mother particle includes a core and a shell layer disposed over a surface of the core. The external additive contains silica particles. The toner mother particle has a hydrophobicity of at least 0% and less than 20%. The external additive has a hydrophobicity of at least 5% and no greater than 20%. The hydrophobicity of the toner mother particle is less than the hydrophobicity of the external additive.

6 Claims, 4 Drawing Sheets

TONER AND METHOD OF MANUFACTURING SAME

INCORPORATION BY REFERENCE

The present application claims priority under 35 U.S.C. §119 to Japanese Patent Application No. 2013-240932, filed Nov. 21, 2013. The contents of this application are incorporated herein by reference in their entirety.

BACKGROUND

The present disclosure relates to a toner and a method of manufacturing the toner, and in particular relates to a capsule toner and a method of manufacturing the capsule toner.

A commonly known toner for example contains hydrophobic silica particles that have undergone treatment using a quaternary ammonium salt-based compound and that have a hydrophobicity of at least 80%.

SUMMARY

A toner according to the present disclosure includes a plurality of toner particles each including a toner mother particle and an external additive adhering to a surface of the toner mother particle. The toner mother particle includes a core and a shell layer disposed over a surface of the core. The external additive contains silica particles. The toner mother particle has a hydrophobicity of at least 0% and less than 20% (0%≤toner mother particle hydrophobicity<20%). The external additive has a hydrophobicity of at least 5% and no greater than 20% (5%≤external additive hydrophobicity≤20%). The hydrophobicity of the toner mother particle is less than the hydrophobicity of the external additive (toner mother particle hydrophobicity<external additive hydrophobicity).

A method of manufacturing a toner according to the present disclosure includes forming a plurality of cores, adding the cores and a shell material into a liquid, obtaining a plurality of toner mother particles that each include a corresponding one of the cores and a shell layer formed over a surface of the core through a polymerization reaction of the shell material in the liquid, preparing an external additive that contains silica particles and that has a hydrophobicity of at least 5% and no greater than 20%, and adhering the external additive to a surface of the toner mother particle. In the obtaining of the toner mother particles, a formation time during which the shell layer is formed through the polymerization reaction is controlled to be at least 30 minutes and no greater than 90 minutes such that the toner mother particles have a hydrophobicity of less than 20% and less than the hydrophobicity of the external additive.

DETAILED DESCRIPTION

The following describes an embodiment of the present disclosure.

A toner according to the present embodiment is a capsule toner for developing an electrostatic latent image. The toner according to the present embodiment is a powder of a large number of particles (herein referred to as toner particles). The toner according to the present embodiment can for example be used in an electrophotographic apparatus (i.e., an image forming apparatus).

The electrophotographic apparatus develops an electrostatic latent image using a developer that includes the toner. As a result of the development, charged toner adheres to a photosensitive member on which the electrostatic latent image is formed. Next, the adhered toner is transferred onto a transfer belt and is subsequently transferred from the transfer belt onto a recording medium (for example, paper). Once the toner has been transferred onto the recording medium, the toner is fixed to the recording medium by heating. Through the above, an image is formed on the recording medium. A full-color image can for example be formed through superposition of toner images of black, yellow, magenta, and cyan colors.

Figure 1:
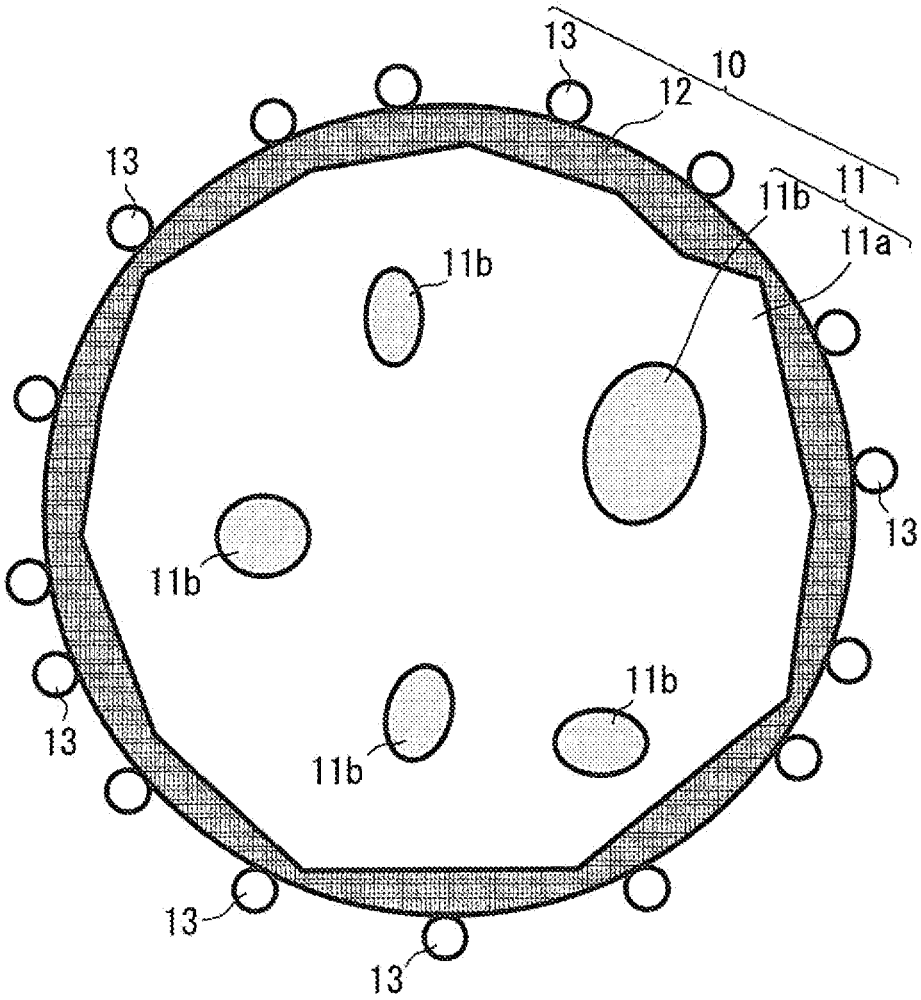
FIG. 1 illustrates a toner particle included in a toner according to an embodiment of the present disclosure.

The following explains composition of the toner (in particular, the toner particles) according to the present embodiment with reference to FIG. 1. FIG. 1 illustrates a toner particle 10 included in the toner according to the present embodiment.

As illustrated in FIG. 1, the toner particle 10 includes a core 11, a shell layer 12 (capsule layer) disposed over the surface of the core 11, and an external additive 13.

The core 11 contains a binder resin 11*a* and an internal additive 11*b* (for example, a colorant or a releasing agent). The core 11 is covered by the shell layer 12. The external additive 13 adheres to the surface of the shell layer 12. Herein, a particle prior to external addition (i.e., a toner particle that does not include an adhered external additive) is referred to as a toner mother particle.

Note that the internal additive 11*b* may be omitted if unnecessary. Also, a plurality of shell layers 12 may alternatively be disposed over the core 11.

The core 11 is preferably anionic and a material of the shell layer 12 (herein referred to as a shell material) is preferably cationic. As a consequence of cores 11 being anionic, the cationic shell material is attracted toward the surface of the cores 11 during formation of shell layers 12. More specifically, it is thought that the shell material which has a positive electrical charge in an aqueous medium is electrically attracted toward the cores 11 which have a negative electrical charge in the aqueous medium, and the shell layers 12 are for example formed over the surface of the cores 11 through in-situ polymerization of the shell material. As a result of the shell material being attracted toward the cores 11, the shell layers 12 can be readily formed in a uniform manner on the surface of the cores 11 without needing to use a dispersant in order to achieve a high degree of dispersion of the cores 11 in the aqueous medium.

The cores 11 having a negative zeta potential (i.e., less than 0 V) when measured in an aqueous medium adjusted to pH 4, is used as an indicator that the cores 11 are anionic (herein the aforementioned zeta potential is referred to simply as a zeta potential at pH 4). In order to strengthen bonding between the cores 11 and the shell layers 12, the cores 11 preferably have a zeta potential at pH 4 of less than 0 V and the toner particles 10 preferably have a zeta potential at pH 4 of greater than 0 V. Note that in the present embodiment, a pH of 4 is the same as the pH of the aqueous medium during formation of the shell layers 12.

Examples of methods of measuring the zeta potential include an electrophoresis method, an ultrasonographic method, and an electrokinetic sonic amplitude (ESA) method.

In the electrophoresis method, an electric field is applied to a dispersion of particles, thereby causing electrophoretic migration of charged particles in the dispersion, and the zeta potential is calculated based on the rate of electrophoretic migration. An example of the electrophoresis method is laser Doppler electrophoresis in which migrating particles are irradiated with laser light and the rate of electrophoretic migration of the particles is calculated from an amount of Doppler shift of scattered light that is obtained. Advantages of laser Doppler electrophoresis are a lack of necessity for particle concentration in the dispersion to be high, a low number of parameters being necessary for calculating the zeta potential, and a high degree of sensitivity in detection of the rate of electrophoretic migration.

The ultrasonographic method involves irradiating a dispersion of particles with ultrasound, thereby causing vibration of electrically charged particles in the dispersion, and calculating the zeta potential based on an electric potential difference that arises due to the vibration.

The ESA method involves applying a high frequency voltage to a dispersion of particles, thereby causing electrically charged particles in the dispersion to vibrate and generate ultrasound. The zeta potential is calculated from the magnitude (intensity) of the ultrasound.

An advantage of the ultrasonography and ESA methods is that the zeta potential can be measured with a high degree of sensitivity even when the concentration of the particles in the dispersion is high (for example, greater than 20% by mass).

The following explains, in order, the cores 11 (i.e., the binder resin 11*a* and the internal additive 11*b*), the shell layers 12, and the external additive 13. Note that herein the term (meth)acrylic is used as a generic term for both acrylic and methacrylic.

[Cores]

The cores 11 contain the binder resin 11*a*. The cores 11 may further contain an internal additive 11*b*. The cores 11 may for example contain a colorant and a releasing agent as internal additives 11*b*. However, a non-essential component (for example, the colorant or the releasing agent) may of course be omitted in accordance with intended use of the toner. The cores 11 may further contain either or both of a charge control agent and a magnetic powder as internal additives 11*b*.

[Binder Resin (Cores)]

The binder resin 11*a* constitutes a large proportion (for example, at least 85% by mass) of components contained in the cores 11. Therefore, the polarity of the binder resin 11*a* has a significant influence on the overall polarity of the cores 11. For example, when the binder resin 11*a* has an ester group, a hydroxyl group, an ether group, an acid group, or a methyl group, the cores 11 have a strong tendency to be anionic. On the other hand, when the binder resin 11*a* for example has an amino group, an amine, or an amide group, the cores 11 have a strong tendency to be cationic.

In order that the binder resin 11*a* is strongly anionic, the binder resin 11*a* preferably has a hydroxyl value (OHV) and an acid value (AV) that are each at least 10 mg KOH/g, and more preferably at least 20 mg KOH/g.

The binder resin 11*a* preferably has a glass transition point (Tg) that is no greater than the curing initiation temperature of a thermosetting resin contained in the shell layers 12. It is thought that fixing can be easily achieved at low temperatures, even during high speed fixing, when Tg of the binder resin 11*a* is as described above. Typically the curing initiation temperature of the thermosetting resin (in particular, a melamine-based resin) is approximately 55° C. The binder resin 11*a* preferably has a Tg of at least 20° C., more preferably at least 30° C. and no greater than 55° C., and particularly preferably at least 30° C. and no greater than 50° C. When Tg of the binder resin 11*a* is at least 20° C., the cores 11 have a low tendency to aggregate during formation of the shell layers 12.

The binder resin 11*a* preferably has a softening point (Tm) of no greater than 100° C. and more preferably no greater than 95° C. It is thought that fixing can be easily achieved at low temperatures, even during high speed fixing, when Tm of the binder resin 11*a* is no greater than 100° C. (more preferably no greater than 95° C.). Furthermore, when Tm of the binder resin 11*a* is no greater than 100° C. (preferably no greater than 95° C.), the cores 11 are partially softened while a curing reaction of the shell layers 12 is proceeding during formation of the shell layers 12 over the surface of the cores 11 in the aqueous medium, and thus the cores 11 have a high tendency to adopt a spherical shape due to surface tension. Tm of the binder resin 11*a* can be adjusted through combination of a plurality of resins that each have a different Tm as the binder resin 11*a*.

Figure 2:
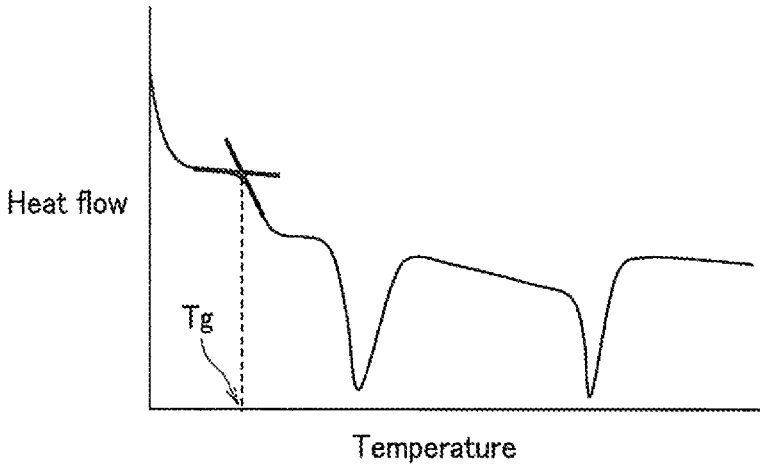
FIG. 2 illustrates a method of reading a glass transition point from a heat absorption curve.

The following explains a method of reading Tg of the binder resin 11*a* from a heat absorption curve with reference to FIG. 2. FIG. 2 is a graph illustrating an example of the heat absorption curve.

Tg of the binder resin 11*a* can be measured according to the following method. A heat absorption curve for the binder resin 11*a* can be obtained using a differential scanning calorimeter (for example, DSC-6220 manufactured by Seiko Instruments Inc.). For example, a heat absorption curve such as shown in FIG. 2 is obtained. Tg of the binder resin 11*a* can be calculated from the heat absorption curve (more specifically, an inflection point of specific heat of the binder resin 11*a*) that is obtained.

Figure 3:
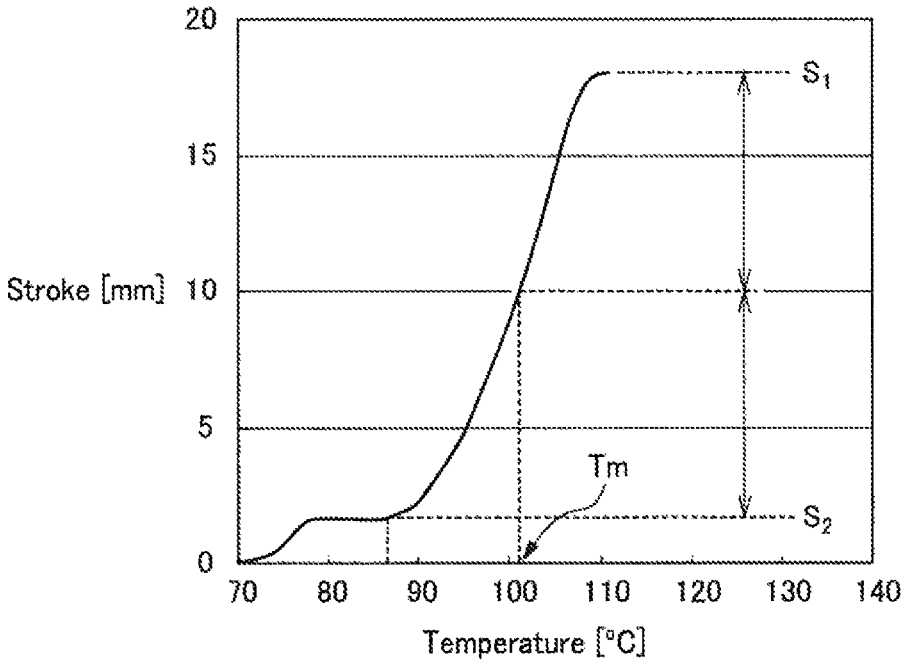
FIG. 3 illustrates a method of reading a softening point from an S-shaped curve.

The following explains a method of reading Tm of the binder resin 11*a* from an S-shaped curve with reference to FIG. 3. FIG. 3 is a graph illustrating an example of the S-shaped curve.

Tm of the binder resin 11*a* can be measured according to the following method. Tm of the binder resin 11*a* can be measured using a capillary rheometer (for example, CFT-500D manufactured by Shimadzu Corporation). An S-shaped curve of stroke (mm)/temperature (° C.) can for example be obtained by placing the binder resin 11*a* (measurement sample) in the capillary rheometer and causing melt flow of the sample under specific conditions. Tm of the binder resin 11*a* can be read from the S-shaped curve that is obtained. In FIG. 3, $S_1$ indicates a maximum stroke value and $S_2$ indicates a base line stroke value at low temperatures. Tm of the measurement sample is determined to be a temperature corresponding to a point on the S-shaped curve at which the stroke is equal to $(S_1+S_2)/2$.

The following continues explanation of the binder resin 11*a* shown in FIG. 1. Molecules of the binder resin 11*a* preferably have a functional group such as an ester group, a hydroxyl group, an ether group, an acid group, a methyl group, or a carboxyl group, and more preferably have a hydroxyl group or a carboxyl group. When the cores 11 (binder resin 11*a*) have a functional group such as listed above, the cores 11 readily react to form chemical bonds with the shell material (for example, methylol melamine).

Formation of chemical bonds such as described above ensures that the cores 11 are strongly bound to the shell layers 12.

The binder resin 11*a* is preferably a thermoplastic resin. Preferable examples of thermoplastic resins that can be used as the binder resin 11*a* include styrene-based resins, acrylic-based resins, styrene-acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene based resins. Among the examples listed above, styrene-acrylic-based resins and polyester resins have excellent properties in terms of colorant dispersibility in the toner, chargeability of the toner, and fixability of the toner on a recording medium.

(Styrene-Acrylic-Based Resins)

A styrene-acrylic-based resin is a copolymer of styrene-based monomers and acrylic-based monomers.

Preferable examples of styrene-based monomers that can be used in preparation of the styrene-acrylic-based resin (binder resin 11*a*) include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of acrylic-based monomers that can be used in preparation of the styrene-acrylic-based resin (binder resin 11*a*) include (meth)acrylic acid, alkyl(meth) acrylates, and hydroxyalkyl(meth)acrylates. Specific examples of preferable alkyl(meth)acrylates include methyl (meth)acrylate, ethyl(meth)acrylate, n-propyl(meth)acrylate, iso-propyl(meth)acrylate, n-butyl(meth)acrylate, iso-butyl(meth)acrylate, and 2-ethylhexyl(meth)acrylate. Specific examples of preferable hydroxyalkyl(meth)acrylates include 2-hydroxyethyl(meth)acrylate, 3-hydroxypropyl(meth)acrylate, 2-hydroxypropyl(meth)acrylate, and 4-hydroxypropyl(meth)acrylate.

A hydroxyl group can be introduced into the styrene-acrylic-based resin by using a monomer having a hydroxyl group (for example, p-hydroxystyrene, m-hydroxystyrene, or a hydroxyalkyl(meth)acrylate) during preparation of the styrene-acrylic-based resin. The hydroxyl value of the styrene-acrylic-based resin can be adjusted through appropriate adjustment of the amount of the monomer having the hydroxyl group that is used in preparation of the styrene-acrylic-based resin.

A carboxyl group can be introduced into the styrene-acrylic-based resin by using (meth)acrylic acid (monomer) during preparation of the styrene-acrylic-based resin. The acid value of the styrene-acrylic-based resin can be adjusted through appropriate adjustment of the amount of (meth) acrylic acid that is used in preparation of the styrene-acrylic-based resin.

When the binder resin 11*a* is a styrene-acrylic-based resin, the styrene-acrylic-based resin preferably has a number average molecular weight (Mn) of at least 2,000 and no greater than 3,000 in order to improve strength of the cores 11 and fixability of the toner. The styrene-acrylic-based resin preferably has a molecular weight distribution (ratio Mw/Mn of mass average molecular weight (Mw) relative to Mn) of at least 10 and no greater than 20. Mn and Mw of the styrene-acrylic-based resin can be measured by gel permeation chromatography.

(Polyester Resins)

A polyester resin used as the binder resin 11*a* can for example be obtained through condensation polymerization or copolymerization of a dihydric alcohol or alcohol having three or more hydroxyl groups and a dicarboxylic acid or carboxylic acid having three or more carboxyl groups.

When the binder resin 11*a* is a polyester resin, preferable examples of alcohols that can be used in preparation of the polyester resin include diols, bisphenols, and alcohols having three or more hydroxyl groups.

Specific examples of preferable diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Specific examples of preferable bisphenols include bisphenol A, hydrogenated bisphenol A, polyoxyethylenated bisphenol A, and polyoxypropylenated bisphenol A.

Specific examples of preferable alcohols having three or more hydroxyl groups include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

When the binder resin 11*a* is a polyester resin, preferable examples of carboxylic acids that can be used in preparation of the polyester resin include dicarboxylic acids and carboxylic acids having three or more carboxyl groups.

Specific examples of preferable dicarboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specifically, n-butyl succinic acid, isobutylsuccinic acid, n-octylsuccinic acid, n-dodecylsuccinic acid, and isododecylsuccinic acid), and alkenyl succinic acids (specifically, n-butenyl succinic acid, isobutenylsuccinic acid, n-octenylsuccinic acid, n-dodecenylsuccinic acid, and isododecenylsuccinic acid).

Specific examples of preferable carboxylic acids having three or more carboxyl groups include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, an ester-forming derivative (for example, an acid halide, an acid anhydride, or a lower alkyl ester) of any of the above-listed dicarboxylic acids or carboxylic acids having three or more carboxyl groups may be used. Herein the term "lower alkyl" refers to an alkyl group having one to six carbon atoms.

The acid value and the hydroxyl value of the polyester resin can be adjusted through appropriate adjustment of the amount of the dihydric alcohol or alcohol having three or more hydroxyl groups and the amount of the dicarboxylic acid or carboxylic acid having three or more carboxyl groups used during preparation of the polyester resin. Increasing the molecular weight of the polyester resin tends to decrease the acid value and the hydroxyl value of the polyester resin.

When the binder resin 11*a* is a polyester resin, the polyester resin preferably has an Mn of at least 1,200 and no greater than 2,000 in order to improve strength of the cores 11 and fixability of the toner. The polyester resin preferably has a molecular weight distribution (i.e., ratio Mw/Mn) of at least 9 and no greater than 20. Mn and Mw of the polyester resin can be measured by gel permeation chromatography.

[Colorant (Cores)]

The cores 11 may further contain a colorant in accordance with necessity thereof. The colorant can be a commonly known pigment or dye selected to match a color of the toner. The amount of the colorant is preferably at least 1 part by mass and no greater than 20 parts by mass relative to 100 parts by mass of the binder resin 11*a*, and more preferably is at least 3 parts by mass and no greater than 10 parts by mass.

(Black Colorants)

The cores 11 may contain a black colorant. The black colorant may for example be composed of carbon black. Alternatively, a colorant may be used that has been adjusted to a black color using colorants such as a yellow colorant, a magenta colorant, and a cyan colorant.

(Non-Black Colorants)

The cores 11 may contain a non-black colorant such as a yellow colorant, a magenta colorant, or a cyan colorant.

Preferable examples of the yellow colorant include condensed azo compounds, isoindolinone compounds, anthraquinone compounds, azo metal complexes, methine compounds, and arylamide compounds. Specific examples of preferable yellow colorants include C.I. pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S, Hansa yellow G, and C.I. vat yellow.

Preferable examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of preferable magenta colorants include C.I. pigment red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Preferable examples of the cyan colorant include copper phthalocyanine compounds, copper phthalocyanine derivatives, anthraquinone compounds, and basic dye lake compounds. Specific examples of preferable cyan colorants include C.I. pigment blue (1, 7, 15, 15:1, 15:2, 15:3, 15:4, 60, 62, and 66), phthalocyanine blue, C.I. vat blue, and C.I. acid blue.

[Releasing Agent (Cores)]

The cores 11 may further contain a releasing agent in accordance with necessity thereof. The releasing agent is for example used in order to improve the fixability or the offset resistance of the toner. In order to improve the fixability or the offset resistance of the toner, the amount of the releasing agent is preferably at least 1 part by mass and no greater than 30 parts by mass relative to 100 parts by mass of the binder resin 11*a*, and more preferably is at least 5 parts by mass and no greater than 20 parts by mass.

Preferable examples of the releasing agent include: aliphatic hydrocarbon-based waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum; waxes having a fatty acid ester as major component such as montanic acid ester wax and castor wax; and waxes in which a part or all of a fatty acid ester has been deoxidized such as deoxidized carnauba wax.

[Charge Control Agent (Cores)]

The cores 11 may further contain a charge control agent in accordance with necessity thereof. The charge control agent is for example used to improve charge stability or a charge rise characteristic of the toner. The anionic strength of the cores 11 can be increased through the cores 11 containing a negatively chargeable charge control agent. The charge rise characteristic of the toner is an indicator of whether or not the toner can be charged to a specific charge level in a short period of time.

[Magnetic Powder (Cores)]

The cores 11 may further contain a magnetic powder in accordance with necessity thereof. When the toner is used as a one-component developer, the amount of the magnetic powder is preferably at least 35 parts by mass and no greater than 60 parts by mass relative to 100 parts by mass of the toner overall, and more preferably is at least 40 parts by mass and no greater than 60 parts by mass.

Preferable examples of the magnetic powder include iron (specifically ferrite and magnetite), ferromagnetic metals (specifically cobalt and nickel), alloys of either or both of iron and a ferromagnetic metal, ferromagnetic alloys subjected to ferromagnetization (for example, heat treatment), and chromium dioxide.

The magnetic powder preferably has a particle size of at least 0.1 μm and no greater than 1.0 μm, and more preferably at least 0.1 μm and no greater than 0.5 μm, in order that the magnetic powder can be uniformly dispersed throughout the binder resin 11*a*.

[Shell Layers]

Preferably a major component of the shell layers 12 is a thermosetting resin. The shell layers 12 preferably contain a nitrogen-containing resin (for example, as an amino group), or a derivative thereof, in order to improve the strength, hardness, and cationic strength of the shell layers 12. When the shell layers 12 contain nitrogen atoms, the shell layers 12 have a high tendency to be positively charged. In order to increase the cationic strength of the shell layers 12, preferably the shell layers 12 contain at least 10% by mass of nitrogen atoms.

Preferable examples of thermosetting resins that can be contained in the shell layers 12 include melamine resins, urea resins, sulfonamide resins, glyoxal resins, guanamine resins, aniline resins, polyimide resins, and derivatives of any of the aforementioned resins. A preferable example of a derivative of a melamine resin is methylol melamine. A polyimide resin contains nitrogen atoms within the molecular framework thereof. Therefore, when the shell layers 12 contain a polyimide resin, the shell layers 12 tend to be strongly cationic. Preferable examples of polyimide resins that can be contained in the shell layers 12 include maleimide-based polymers and bismaleimide-based polymers (for example, amino-bismaleimide polymers and bismaleimide triazine polymers).

In particular, the thermosetting resin contained in the shell layers 12 is preferably a resin (herein referred to as an amino-aldehyde resin) produced through polycondensation of an aldehyde (for example, formaldehyde) and a compound having an amino group. Note that a melamine resin is a polycondensate of melamine and formaldehyde. A urea resin is a polycondensate of urea and formaldehyde. A glyoxal resin is a polycondensate of formaldehyde and a reaction product of glyoxal and urea.

The thermosetting resin contained in the shell layers 12 can be prepared using a monomer (shell material) such as methylol melamine, benzoguanamine, acetoguanamine, or spiroguanamine. The shell material is preferably a material that dissolves or disperses in water.

Preferably at least 80% by mass of resin contained in the shell layer 12 is the thermosetting resin, more preferably at least 90% by mass of the resin is the thermosetting resin, and particularly preferably 100% by mass of the resin is the thermosetting resin.

The shell layers 12 preferably have a thickness of at least 1 nm and no greater than 20 nm, and more preferably of at least 1 nm and no greater than 10 nm. The thickness of the shell layers 12 being no greater than 20 nm enables the shell layers 12 to be easily ruptured during fixing of the toner on a recording medium through, for example, application of heat and pressure. As a result, softening or melting of the binder resin 11*a* and the releasing agent contained in the cores 11 proceeds quickly, enabling fixing of the toner to the recording medium at low temperatures. Also, the thickness of the shell layers 12 being no greater than 20 nm ensures that charge of the shell layers 12 is not excessively high, and thus ensures that an image is formed correctly. On the other hand, the thickness of the shell layers 12 being at least 1 nm ensures that the shell layers 12 have sufficient strength, enabling restriction of rupturing of the shell layers 12 during transportation due to, for example, an impact.

The thickness of the shell layers 12 can be measured by analyzing transmission electron microscopy (TEM) images of cross-sections of the toner particles 10 using commercially available image-analyzing software (for example, WinROOF provided by Mitani Corporation).

Note that the shell layers 12 may further contain a positively chargeable charge control agent in order to increase cationic strength (positive chargeability) of the shell layers 12.

[External Additive]

The external additive 13 is for example used in order to improve fluidity or handleability of the toner. In order to improve the fluidity or the handleability of the toner, the amount of the external additive 13 is preferably at least 0.5 parts by mass and no greater than 10 parts by mass relative to 100 parts by mass of the toner mother particles, and more preferably is at least 1 part by mass and no greater than 5 parts by mass. Also, in order to improve the fluidity or the handleability of the toner, the external additive 13 preferably has a particle size of at least 0.01 μm and no greater than 1.0 μm.

In the toner according to the present embodiment, each of the toner mother particles includes the core 11 and the shell layer 12 disposed over the surface of the core 11. The external additive 13 contains silica particles. The toner mother particles have a hydrophobicity of at least 0% and less than 20% (i.e., 0%≤toner mother particle hydrophobicity≤20%). The external additive 13 has a hydrophobicity of at least 5% and no greater than 20% (i.e., 5%≤external additive 13 hydrophobicity≤20%). The hydrophobicity of the toner mother particles is lower than the hydrophobicity of the external additive 13 (i.e., toner mother particle hydrophobicity<external additive 13 hydrophobicity).

In the present embodiment (and also in the following examples), hydrophobicity is a value measured by a methanol titration test. More specifically, in the methanol titration test, 0.5 g of the toner mother particles or 0.05 g of the external additive 13 is added to 50 mL of water. The resultant liquid is stirred while titrating methanol into the resultant liquid using a burette, until all of the toner mother particles or the external additive 13 are wetted. The hydrophobicity is quoted as a value representing a volume percentage of methanol in a resultant methanol-water mixture at an end point of the titration.

In the toner according to the present embodiment, the toner mother particles have a hydrophobicity of less than 20% and the external additive 13 has a hydrophobicity of at least 5% and no greater than 20% (i.e., 5%≤external additive 13 hydrophobicity≤20%). As a result of the hydrophobicity of the toner mother particles and the hydrophobicity of the external additive 13 both being low (i.e., the toner mother particles and the external additive 13 both being hydrophilic), the surface of the toner particles 10 can be covered with water (i.e., the toner particles 10 can retain moisture). Also, as a result of the hydrophobicity of the external additive 13 not being excessively low (specifically at least 5%), the surface of the toner particles 10 becomes covered with an appropriate amount of water. It is thought that when the surface of the toner particles 10 is covered with an appropriate amount, fluctuations in ambient conditions (for example, fluctuations in temperature or humidity) cause relatively little change in the amount of water on the surface of the toner particles 10. Furthermore, the hydrophobicity of the toner mother particles being lower than the hydrophobicity of the external additive 13 in the toner according to the present embodiment is thought to ensure appropriate moisture adsorption. As a result of the surface of the toner particles 10 being covered with an appropriate amount of water, the toner particles 10 can retain high chargeability (in particular, charge retention) even if fluctuations occur in ambient conditions (for example, fluctuations in temperature or humidity). Therefore, the toner according to the present embodiment has excellent charge stability.

With regards to the toner after addition of the external additive 13, the hydrophobicity of the toner mother particles and the hydrophobicity of the external additive 13 may be measured by separating the toner mother particles from the external additive 13. The toner mother particles can for example be separated from the external additive 13 by a gas flow process or a wet process.

In a method of manufacturing the toner according to the present embodiment, the cores 11 are formed and are subsequently added to a liquid with the shell material. Next, the shell layers 12 are formed over the surface of the cores 11 through a polymerization reaction of the shell material in the liquid. Through the above, toner mother particles are obtained that each include a core 11 and a shell layer 12. Next, the external additive 13 containing silica particles and having a hydrophobicity of at least 5% and no greater than 20% is prepared. The external additive 13 is subsequently adhered to the surface of the toner mother particles. During formation of the toner mother particles, a formation time (polymerization time) of the shell layers 12 is controlled to be at least 30 minutes and no greater than 90 minutes such that the toner mother particles have a hydrophobicity of less than 20% and less than the hydrophobicity of the external additive 13. The method described above enables the hydrophobicity of the toner mother particles to be simply adjusted to within the desired range.

The silica particles contained in the external additive 13 are preferably hydrophilic silica particles that have undergone hydrophobic treatment. Note that the external additive 13 may be entirely composed of hydrophilic silica particles that have undergone hydrophobic treatment.

At least a portion of hydroxyl groups present at the surface of the silica particles contained in the external additive 13 are preferably substituted with either one of an alkylsilane and an aminosilane. The above enables simple adjustment of the hydrophobicity of the external additive 13 to at least 5% and no greater than 20%.

A difference between a proportion of the hydroxyl groups substituted with the alkylsilane and a proportion of the hydroxyl groups substituted with the aminosilane is preferably at least 0% and no greater than 5%. The above enables simple adjustment of the hydrophobicity of the external additive 13 to at least 5% and no greater than 20%.

The shell layers 12 preferably contain a thermosetting resin in order to improve high-temperature preservability of the toner. In order to form shell layers 12 such as described above, the shell material added during formation of the shell layers 12 is preferably a prepolymer or a monomer of a thermosetting resin.

EXAMPLES

Table 1 shows details of toners A-Q according to examples of the present disclosure and comparative examples. Note that in a situation in which all of the hydroxyl groups have been substituted, the proportion of substituted hydroxyl groups is considered to be 100%.

TABLE 1

| | Capsulation | | Proportion of substituted silica hydroxyl groups | | Hydrophobicity (%) | |
|---|---|---|---|---|---|---|
| Toner | Stirring temperature (° C.) | Stirring time (minutes) | Proportion substituted with alkylsilane (%) | Proportion substituted with aminosilane (%) | Toner mother particles | Silica external additive |
| Toner A | 65 | 60 | 30 | 30 | 5 | 10 |
| Toner B | 65 | 60 | 40 | 40 | 5 | 18 |
| Toner C | 60 | 30 | 30 | 30 | 2 | 10 |
| Toner D | 70 | 90 | 40 | 40 | 15 | 18 |
| Toner E | 60 | 30 | 25 | 25 | 2 | 6 |
| Toner F | 70 | 90 | 40 | 45 | 15 | 20 |
| Toner G | 65 | 60 | 30 | 30 | 5 | 10 |
| Toner H | 65 | 60 | 30 | 30 | 5 | 10 |
| Toner I | 65 | 75 | 25 | 25 | 10 | 6 |
| Toner J | 70 | 120 | 30 | 30 | 22 | 10 |
| Toner K | 65 | 75 | 45 | 45 | 10 | 23 |
| Toner L | 75 | 120 | 50 | 50 | 24 | 25 |
| Toner M | 65 | 60 | 20 | 20 | 5 | 2 |
| Toner N | 65 | 120 | 30 | 30 | 20 | 10 |
| Toner O | 65 | 75 | 25 | 25 | 10 | 6 |
| Toner P | 65 | 75 | 25 | 25 | 11 | 6 |
| Toner Q | 70 | 90 | 35 | 45 | 15 | 22 |

The following explains, in order, a preparation method, an evaluation method, and evaluation results of the toners A-Q. Unless otherwise stated, evaluation results (values indicating shapes, properties, and the like) for the toners are average values measured with respect to an appropriate number of toner particles.

[Preparation Method of Toner A]

<Core Preparation>

In the preparation method of the toner A, 750 g of a low viscosity polyester resin, 100 g of a medium viscosity polyester resin, 150 g of a high viscosity polyester resin, 55 g of a releasing agent, and 40 g of a colorant were mixed at a rotation speed of 2,400 rpm using a mixer (FM mixer manufactured by Nippon Coke & Engineering Co. Ltd.). Note that the melt viscosity of the binder resin 11*a* (polyester resin) can be decreased by increasing a ratio of the low viscosity polyester resin contained therein.

The low viscosity polyester resin had a Tg of 38° C. and a Tm of 65° C. The medium viscosity polyester resin had a Tg of 53° C. and a Tm of 84° C. The high viscosity polyester resin had a Tg of 71° C. and a Tm of 120° C.

KET Blue 111 (phthalocyanine blue) manufactured by DIC Corporation was used as the colorant. Carnauba Wax No. 1 manufactured by S. Kato & Co. was used as the releasing agent.

Next, the resulting mixture was melt-kneaded using a twin screw extruder (PCM-30 manufactured by Ikegai Corp.) under conditions of a material addition rate of 5 kg/hour, an shaft rotation speed of 160 rpm, and a setting temperature range of at least 100° C. and no greater than 130° C. The resulting melt-knead was subsequently cooled.

Next, the melt-knead was roughly pulverized using a mechanical pulverizer (Rotoplex (registered Japanese trademark) 16/8 manufactured by Hosokawa Micron Corporation). After the rough pulverization, fine pulverization was performed on the roughly pulverized product using a jet mill (Model-I Super Sonic Jet Mill manufactured by Nippon Pneumatic Mfg. Co., Ltd.). The finely pulverized product obtained through the fine pulverization was classified using a classifying apparatus (Elbow-Jet EJ-LABO manufactured by Nittetsu Mining Co., Ltd.). Cores having a median diameter (volume distribution standard) of 6.0 μm were obtained through the classification. The obtained cores were anionic.

<Shell Layer Formation>

A three-necked flask having a capacity of 1 L and equipped with a thermometer and a stiffing impeller was set up, and 500 mL of ion exchanged water and 50 g of sodium polyacrylate (JURYMER (registered Japanese trademark) AC-103 manufactured by Toagosei Co., Ltd.) were added to the flask. Through the above, an aqueous solution of sodium polyacrylate was obtained in the flask.

Next, 100 g of the cores (powder) prepared as described above were added to the aqueous solution of sodium polyacrylate. After addition of the cores, the contents of the flask were sufficiently stirred at room temperature. The above yielded a dispersion of the cores in the flask.

Next, the dispersion of the cores was filtered using filter paper having a pore size of 3 μm. The filtration separated the cores from the filtrate. The cores obtained through the filtration were next re-dispersed in ion exchanged water. Filtration and re-dispersion of the cores was repeated five times in order to wash the cores. Next, a suspension of 100 g of the cores in 500 mL of ion exchanged water was prepared in a flask.

After adding 1 g of methylol urea (Mirbane resin SU-100 manufactured by Showa Denko K.K.; solid content concentration 80% by mass) to the flask, the contents of the flask were stiffed in order to dissolve the methylol urea in the suspension. The suspension in the flask was subsequently adjusted to pH 4 through addition of dilute hydrochloric acid to the flask.

After pH adjustment, the suspension was transferred to a 1 L separable flask. Next, the contents of the flask were stirred while heating the contents such as to increase the internal temperature of the flask to 65° C. The contents of the flask were stiffed for a further 60 minutes while maintaining the internal temperature at 65° C. Heating of the contents of the flask caused a polymerization reaction of the shell material in the flask. Through the polymerization reaction, cationic shell layers composed mainly of thermosetting resin (urea resin) were formed over the surface of the cores. As a result of the above, a dispersion containing toner mother particles was obtained.

(Washing and Drying)

The toner mother particles (toner cores and shell layers) were isolated by filtration (solid-liquid separation) of the toner mother particles from the dispersion thereof. The toner mother particles were subsequently re-dispersed in ion exchanged water. Dispersion and filtration of the toner mother particles was repeated alternately to wash the toner mother particles. Next, the toner mother particles were dried. As a result of repeated washing (dispersion and filtration), almost none of the dispersant (sodium polyacrylate) remained in or on the surface of the toner mother particles. The toner mother particles that were obtained had a hydrophobicity of 5%.

<Hydrophobicity Measurement Method>

The hydrophobicity of the toner mother particles was measured by a methanol titration test. More specifically, in the methanol titration test, 0.5 g of the toner mother particles was added to 50 mL of water. The resultant liquid was stirred while titrating methanol into the resultant liquid using a burette until all of the toner mother particles were wetted. The hydrophobicity was calculated as a value representing a volume percentage of methanol in a resultant methanol-water mixture at an end point of the titration.

(External Additive)

The external additive was prepared through hydrophobic treatment of hydrophilic silica. Hydrophilic fumed silica (AEROSIL (registered Japanese trademark) 130 manufactured by Nippon Aerosil Co., Ltd.) having a BET specific surface area of 130 $m^2/g$ was used as the hydrophilic silica.

The hydrophobic treatment involved substituting hydroxyl groups at the surface of the hydrophilic silica such that a proportion of the hydroxyl groups substituted with an alkylsilane was 30% and a proportion of the hydroxyl groups substituted with an aminosilane was 30%. A polyethylene oxide-containing alkoxysilane (A-1230 manufactured by NUC Corporation) was used as the alkylsilane. Also, 3-Aminopropyltriethoxysilane (KBE-903 manufactured by Shin-Etsu Chemical Co., Ltd.) was used as the aminosilane. The external additive that was obtained had a hydrophobicity of 10%. The hydrophobicity of the external additive was measured in the same way as the hydrophobicity of the toner mother particles but with 0.05 g of the external additive being added instead of 0.5 g of the toner mother particles.

Next, 1.5 parts by mass of the external additive (hydrophobically treated hydrophilic silica) were mixed with 100 parts by mass of the dried toner mother particles. Through the process described above, a large number of toner particles of the toner A were obtained.

[Preparation Method of Toner B]

In the preparation method of the toner B, the proportion of the hydroxyl groups substituted with the alkylsilane was 40% instead of 30% and the proportion of the hydroxyl groups substituted with the aminosilane was 40% instead of 30% during the hydrophobic treatment of the external additive. In all other aspects the toner B was prepared according to the same preparation method as the toner A. The external additive used in preparation of the toner B had a hydrophobicity of 18%. The toner mother particles used in preparation of the toner B had a hydrophobicity of 5%.

[Preparation Method of Toner C]

In the preparation method of the toner C, the stirring temperature was 60° C. instead of 65° C. and the stirring time was 30 minutes instead of 60 minutes during formation of the shell layers (capsulation). In all other aspects the toner C was prepared according to the same preparation method as the toner A. The external additive used in preparation of the toner C had a hydrophobicity of 10%. The toner mother particles used in preparation of the toner C had a hydrophobicity of 2%.

[Preparation Method of Toner D]

In the preparation method of the toner D, the stirring temperature was 70° C. instead of 65° C. and the stirring time was 90 minutes instead of 60 minutes during formation of the shell layers (capsulation). In all other aspects the toner D was prepared according to the same preparation method as the toner B. The external additive used in preparation of the toner D had a hydrophobicity of 18%. The toner mother particles used in preparation of the toner D had a hydrophobicity of 15%.

[Preparation Method of Toner E]

In the preparation method of the toner E, the proportion of the hydroxyl groups substituted with the alkylsilane was 25% instead of 30% and the proportion of the hydroxyl groups substituted with the aminosilane was 25% instead of 30% during the hydrophobic treatment of the external additive. In all other aspects the toner E was prepared according to the same preparation method as the toner C. The external additive used in preparation of the toner E had a hydrophobicity of 6%. The toner mother particles used in preparation of the toner E had a hydrophobicity of 2%.

[Preparation Method of Toner F]

In the preparation method of the toner F, the proportion of the hydroxyl groups substituted with the aminosilane was 45% instead of 40%. In all other aspects the toner F was prepared according to the same preparation method as the toner D. The external additive used in preparation of the toner F had a hydrophobicity of 20%. The toner mother particles used in preparation of the toner F had a hydrophobicity of 15%.

[Preparation Method of Toner G]

In the preparation method of the toner G, methylol melamine (Nikaresin S-176 manufactured by Nippon Carbide Industries Co., Inc.; solid content concentration 80% by mass) was used instead of methylol urea (Mirbane resin SU-100 manufactured by Showa Denko K.K.). In all other aspects the toner G was prepared according to the same preparation method as the toner A. The additive amount of methylol melamine (Nikaresin S-176 manufactured by Nippon Carbide Industries Co., Inc.) was 1 g. The external additive used in preparation of the toner G had a hydrophobicity of 10%. The toner mother particles used in preparation of the toner G had a hydrophobicity of 5%.

[Preparation Method of Toner H]

In the preparation method of the toner H, methylol melamine (Nikaresin S-260 manufactured by Nippon Carbide Industries Co., Inc.; solid content concentration 80% by mass) was used instead of methylol urea (Mirbane resin SU-100 manufactured by Showa Denko K.K.). In all other aspects the toner H was prepared according to the same preparation method as the toner A. The additive amount of methylol melamine (Nikaresin S-260 manufactured by Nippon Carbide Industries Co., Inc.) was 1 g. The external additive used in preparation of the toner H had a hydrophobicity of 10%. The toner mother particles used in preparation of the toner H had a hydrophobicity of 5%.

[Preparation Method of Toner I]

In the preparation method of the toner I, the stirring temperature was 65° C. instead of 60° C. and the stirring time was 75 minutes instead of 30 minutes during formation of the shell layers (capsulation). In all other aspects the toner I was prepared according to the same preparation method as the toner E. The external additive used in preparation of the toner I had a hydrophobicity of 6%. The toner mother particles used in preparation of the toner I had a hydrophobicity of 10%.

[Preparation Method of Toner J]

In the preparation method of the toner J, the stirring temperature was 70° C. instead of 65° C. and the stirring time was 120 minutes instead of 60 minutes during formation of the shell layers (capsulation). In all other aspects the toner J was prepared according to the same preparation method as the toner A. The external additive used in preparation of the toner J had a hydrophobicity of 10%. The toner mother particles used in preparation of the toner J had a hydrophobicity of 22%.

[Preparation Method of Toner K]

In the preparation method of the toner K, the proportion of the hydroxyl groups substituted with the alkylsilane was 45% instead of 25% and the proportion of the hydroxyl groups substituted with the aminosilane was 45% instead of 25% during the hydrophobic treatment of the external additive. In all other aspects the toner K was prepared according to the same preparation method as the toner I. The external additive used in preparation of the toner K had a hydrophobicity of 23%. The toner mother particles used in preparation of the toner K had a hydrophobicity of 10%.

[Preparation Method of Toner L]

The preparation method of the toner L was the same as the preparation method of the toner A, except for in terms of the conditions described below.

In the preparation method of the toner L, the proportion of the hydroxyl groups substituted with the alkylsilane was 50% instead of 30% and the proportion of the hydroxyl groups substituted with the aminosilane was 50% instead of 30% during the hydrophobic treatment of the external additive. Also, the stirring temperature was 75° C. instead of 65° C. and the stirring time was 120 minutes instead of 60 minutes during formation of the shell layers (capsulation). The external additive used in preparation of the toner L had a hydrophobicity of 25%. The toner mother particles used in preparation of the toner L had a hydrophobicity of 24%.

[Preparation Method of Toner M]

In the preparation method of the toner M, the proportion of the hydroxyl groups substituted with the alkylsilane was 20% instead of 30% and the proportion of the hydroxyl groups substituted with the aminosilane was 20% instead of 30% during the hydrophobic treatment of the external additive. In all other aspects the toner M was prepared according to the same preparation method as the toner A. The external additive used in preparation of the toner M had a hydrophobicity of 2%. The toner mother particles used in preparation of the toner M had a hydrophobicity of 5%.

[Preparation Method of Toner N]

In the preparation method of the toner N, the stirring time was 120 minutes instead of 60 minutes during formation of the shell layers (capsulation). In all other aspects the toner N was prepared according to the same preparation method as the toner A. The external additive used in preparation of the toner N had a hydrophobicity of 10%. The toner mother particles used in preparation of the toner N had a hydrophobicity of 20%.

[Preparation Method of Toner O]

In the preparation method of the toner O, methylol melamine (Nikaresin S-176 manufactured by Nippon Carbide Industries Co., Inc.; solid content concentration 80% by mass) was used instead of methylol urea (Mirbane resin SU-100 manufactured by Showa Denko K.K.). In all other aspects the toner O was prepared according to the same preparation method as the toner I. The additive amount of methylol melamine (Nikaresin S-176 manufactured by Nippon Carbide Industries Co., Inc.) was 1 g. The external additive used in preparation of the toner O had a hydrophobicity of 6%. The toner mother particles used in preparation of the toner O had a hydrophobicity of 10%.

[Preparation Method of Toner P]

In the preparation method of the toner P, methylol melamine (Nikaresin S-260 manufactured by Nippon Carbide Industries Co., Inc.; solid content concentration 80% by mass) was used instead of methylol urea (Mirbane resin SU-100 manufactured by Showa Denko K.K.). In all other aspects the toner P was prepared according to the same preparation method as the toner I. The additive amount of methylol melamine (Nikaresin S-260 manufactured by Nippon Carbide Industries Co., Inc.) was 1 g. The external additive used in preparation of the toner P had a hydrophobicity of 6%. The toner mother particles used in preparation of the toner P had a hydrophobicity of 11%.

[Preparation Method of Toner Q]

In the preparation method of the toner Q, the proportion of the hydroxyl groups substituted with the alkylsilane was 35% instead of 40%. In all other aspects the toner Q was prepared according to the same preparation method as the toner F. The external additive used in preparation of the toner Q had a hydrophobicity of 22%. The toner mother particles used in preparation of the toner Q had a hydrophobicity of 15%.

[Evaluation Method]

The following explains the evaluation method of each of the samples (i.e., the toners A-Q).

(Charge)

A ball mill was used to mix 100 parts by mass of a carrier (carrier for FS-05300DN manufactured by KYOCERA Document Solutions Inc.) and 10 parts by mass of the sample (toner). An evaluation developer was obtained through the above.

Charge was measured for an evaluation developer (herein referred to as a first evaluation developer) left to stand for 24 hours at an ambient temperature of 20° C. and relative humidity (RH) of 65%, an evaluation developer (herein referred to as a second evaluation developer) left to stand for 24 hours at an ambient temperature of 35° C. and relative humidity of 80%, and an evaluation developer (herein referred to as a third evaluation developer) left to stand for 24 hours at an ambient temperature of 10° C. and relative humidity of 10%. The charge was measured using a portable charge measurement device that uses a "draw off" method (Model 212HS manufactured by TREK Japan KK).

In evaluation of the charge of the first, second, and third evaluation developers, a charge of at least 10 μC/g and no greater than 30 μC/g was evaluated as good, and a charge of less than 10 μC/g or greater than 30 μC/g was evaluated as poor.

(Fogging)

First, 100 g of the carrier (carrier for FS-05300DN manufactured by KYOCERA Document Solutions Inc.) and 6 g of the sample (toner) were added to a 100 mL plastic container, and the carrier and the toner were stirred for 10 minutes using a powder mixer (Rocking Mixer (registered Japanese trademark) manufactured by Aichi Electric Co., Ltd.). Next, the resultant mixture (developer) in the plastic container was caused to deteriorate.

Figure 4:
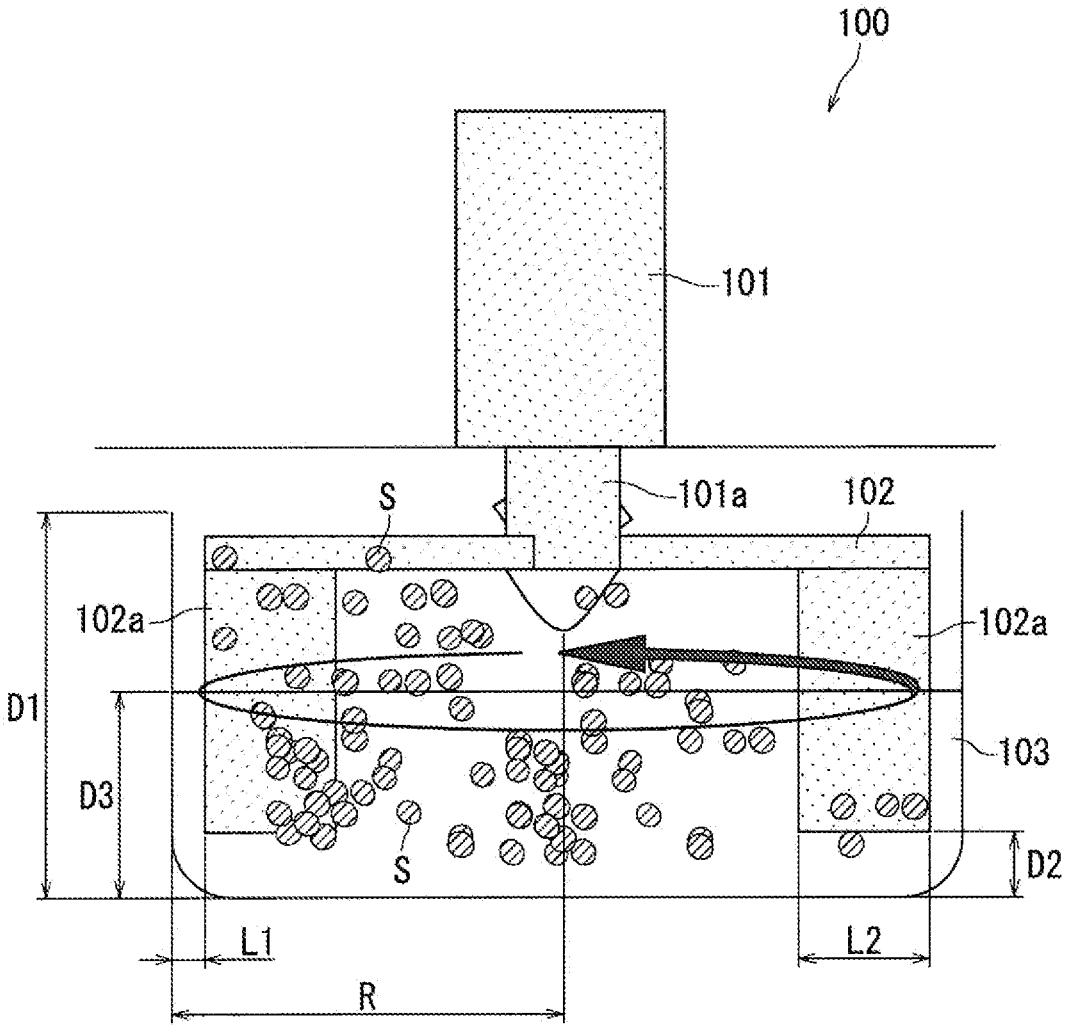
FIG. 4 illustrates a method of causing deterioration of a developer during evaluation of fogging.

The following explains a method of causing deterioration of the toner with reference mainly to FIG. 4. FIG. 4 illustrates a deterioration device 100 for causing deterioration of the toner.

As illustrated in FIG. 4, the deterioration device 100 includes a rotational driver 101 (for example, a motor), a rotational shaft 101*a*, a plate 102, and a dish 103. The rotational driver 101 causes rotation of the rotational shaft 101*a*. The plate 102 integrally rotates with the rotational shaft 101*a*. The plate 102 has projections 102*a* (blades). The dish 103 is an aluminum dish having a capacity of approximately 100 mL.

The dish 103 has a radius R of 28 mm. The dish 103 has a depth D1 of 25 mm. A distance D2 between the bottom surface of the dish 103 and the projections 102*a* of the plate 102 is 1 mm A distance D3 between the bottom surface of the dish 103 and a top surface of the carrier is 5 mm A distance L1 between the side surface of the dish 103 and the projections 102*a* of the plate 102 is 3 mm. The projections 102*a* of the plate 102 have a width L2 of 20 mm.

The mixture (developer S) in the plastic container was added into the dish 103. Next, the developer S was mixed for 10 minutes through rotation of the rotational shaft 101*a*, and thus also the plate 102, by the rotational driver 101. Through the above, the developer S became caught between the dish 103 and the projections 102*a*, thereby causing deterioration of the developer S. Deteriorated developer was obtained as a result of the process described above.

Next, 3 g of the deteriorated developer was added to a 20 mL bottle with 0.18 g of the original sample (non-deteriorated toner). The contents of the bottle were mixed for one minute using a powder mixer (Rocking Mixer (registered Japanese trademark) manufactured by Aichi Electric Co., Ltd.). An evaluation toner was obtained through the above process.

Next, 2 g of the evaluation toner was mounted uniformly on an SUS304 sleeve (length 230 mm, diameter 20 mm) having an internal magnet, and an electrode was set up at a distance of 4.5 mm from the sleeve. The sleeve was rotated while applying a voltage of 1.5 kV to the electrode for 30 seconds and an amount of scattering toner (oppositely charged toner) that adhered to the electrode was measured as a value for fogging.

An amount of scattering toner of less than 20 mg was evaluated as good and an amount of scattering toner of 20 mg or greater was evaluated as poor.

[Evaluation Results]

Table 2 shows evaluation results of charge and fogging for each of the toners A-Q.

TABLE 2

| Toner | Charge after being left for 24 hours (μC/g) 20° C. 65% RH | 35° C. 80% RH | 10° C. 10% RH | Fogging (mg) |
|---|---|---|---|---|
| Toner A | 15 | 12 | 17 | 10 |
| Toner B | 24 | 20 | 27 | 8 |
| Toner C | 14 | 12 | 16 | 12 |
| Toner D | 26 | 22 | 29 | 7 |
| Toner E | 12 | 11 | 15 | 18 |
| Toner F | 28 | 23 | 29 | 6 |
| Toner G | 17 | 13 | 19 | 9 |
| Toner H | 14 | 11 | 15 | 12 |
| Toner I | 14 | 9 | 16 | 18 |
| Toner J | 20 | 13 | 28 | 23 |
| Toner K | 22 | 16 | 33 | 17 |
| Toner L | 31 | 23 | 40 | 3 |
| Toner M | 10 | 8 | 14 | 30 |
| Toner N | 24 | 17 | 32 | 10 |
| Toner O | 15 | 9 | 18 | 19 |
| Toner P | 13 | 8 | 17 | 20 |
| Toner Q | 29 | 24 | 31 | 5 |

For each of the toners A-H and J, the charge of each of the first, second, and third evaluation developers was at least 10 μC/g and no greater than 30 μC/g.

For each of the toners I, M, O, and P, the charge of the second evaluation developer was less than 10 μC/g.

For each of the toners K, N, and Q, the charge of the third evaluation developer was greater than 30 μC/g.

For the toner L, the charge of each of the first and third evaluation developers was greater than 30 μC/g.

For each of the toners A-I, K, L, N, O, and Q, the amount of scattering toner (fogging) was less than 20 mg.

For each of the toners J, M, and P, the amount of scattering toner (fogging) was at least 20 mg.

As explained above, in each of the toners A-H (i.e., toners according to examples of the present disclosure), the toner mother particles had a hydrophobicity of at least 0% and less than 20% (refer to Table 1). Also, in each of the toners A-H, the external additive had a hydrophobicity of at least 5% and no greater than 20% (refer to Table 1). Furthermore, the hydrophobicity of the toner mother particles was less than the hydrophobicity of the external additive (refer to Table 1). The toners A-H, having the compositions described above, had excellent charge stability (refer to Table 2). Each of the toners A-H had a low tendency to cause image fogging during image formation (refer to Table 2).

In the preparation methods of the toners A-H, after forming the cores, the cores and the shell material were added into a liquid. Next, the shell layers were formed over the surface of the cores through a polymerization reaction of the shell material in the liquid. Through the above, toner mother particles were obtained that each included a core and a shell layer. Next, the external additive containing silica particles and having a hydrophobicity of at least 5% and no greater than 20% was prepared. The external additive was subsequently adhered to the surface of the toner mother particles. In the obtaining of the toner mother particles, a formation time of the shell layers (polymerization time) was controlled to be at least 30 minutes and no greater than 90 minutes (refer to Table 1). Through the above, the toner mother particles had a hydrophobicity of less than 20% and less than the hydrophobicity of the external additive. The method described above enabled simple adjustment of the hydrophobicity of the toner mother particles to within the desired range.

For each of the toners A-H, a difference between a proportion of the hydroxyl groups substituted with the alkylsilane and a proportion of the hydroxyl groups substituted with the aminosilane was at least 0% and no greater than 5%. More specifically, for each of the toners A-E, U, and H, the proportion of the hydroxyl groups substituted with the alkylsilane and the proportion of the hydroxyl groups substituted with the aminosilane were equal; thus, the difference therebetween was 0%. For the toner F, the difference between the proportion of the hydroxyl groups substituted with the alkylsilane and the proportion of the hydroxyl groups substituted with the aminosilane was 5% (=45%−40%).

In each of the toners A-H, the shell layers were composed exclusively of thermosetting resin. Also, in the preparation methods of the toners A-H, a prepolymer of the thermosetting resin was added as the shell material.

The present disclosure is not in any way limited by the above examples.

The toner is thought to have excellent charge stability so long as the toner mother particles have a hydrophobicity of at least 0% and less than 20%, the silica particle-containing external additive has a hydrophobicity of at least 5% and no greater than 20%, and the hydrophobicity of the toner mother particles is less than the hydrophobicity of the external additive.

Furthermore, the hydrophobicity of the toner mother particles can be simply adjusted to within the desired range during preparation of the toner mother particles by controlling the formation time of the shell layers (polymerization time) to be at least 30 minutes and no greater than 90 minutes, such that the hydrophobicity of the toner mother particles is less than 20% and less than the hydrophobicity (at least 5% and no greater than 20%) of the silica particle-containing external additive.

What is claimed is:

1. A toner comprising a plurality of toner particles each including:

a toner mother particle; and an external additive adhering to a surface of the toner mother particle, wherein the toner mother particle includes a core and a shell layer disposed over a surface of the core, the external additive contains silica particles having alkylsilane groups and aminosilane groups, the toner mother particle has a hydrophobicity of at least 0% and less than 20%, the hydrophobicity of the toner mother particle being represented by a volume percentage of methanol in a methanol-water mixture when the toner mother particle becomes entirely wetted in a methanol titration test, the external additive has a hydrophobicity of at least 5% and no greater than 20%, the hydrophobicity of the external additive being represented by a volume percentage of methanol in a methanol-water mixture when the external additive becomes entirely wetted in a methanol titration test, and the hydrophobicity of the toner mother particle is lower than the hydrophobicity of the external additive.

2. A toner according to claim 1, wherein a difference in hydrophobicity between the alkylsilane groups and the aminosilane groups is at least 0% and no greater than 5%.

3. A toner according to claim 1, wherein the shell layer contains a thermosetting resin.

4. A toner according to claim 1, wherein the shell layer contains a urea resin.

5. A toner according to claim 4, wherein the urea resin includes a methylol urea resin.

6. A toner according to claim 1, wherein the shell layer contains a melamine resin.

* * * * *